United States Patent [19]

Rawlinson et al.

[11] Patent Number: 4,778,614

[45] Date of Patent: Oct. 18, 1988

[54] SOLUBLE-OIL CUTTING FLUID

[75] Inventors: Anthony P. Rawlinson, Hanworth; Robert D. Whitby, Woking; James White, Hanworth, all of England

[73] Assignee: The British Petroleum Company p.l.c., London, England

[21] Appl. No.: 785,606

[22] Filed: Oct. 8, 1985

[30] Foreign Application Priority Data

Oct. 11, 1984 [GB] United Kingdom ..... 8425712

[51] Int. Cl.[4] ..... C10M 173/00; C10M 135/10

[52] U.S. Cl. ..... 252/49.5; 252/33; 252/33.2; 252/34; 252/49.3

[58] Field of Search ..... 252/49.5, 45.0, 33, 252/34, 39, 42.1

[56] References Cited

U.S. PATENT DOCUMENTS

| | | | |
|---|---|---|---|
| 2,367,468 | 1/1945 | Mixon et al. | 252/33 |
| 2,883,340 | 4/1959 | Wasley et al. | 252/33 |
| 2,967,831 | 1/1961 | Hommer | 252/77 |
| 3,609,076 | 9/1971 | Sabol et al. | 252/33.3 |
| 3,813,337 | 5/1974 | Sheldahl | 252/33.4 |
| 3,931,021 | 1/1976 | Lundberg | 252/33 |
| 3,959,164 | 5/1976 | Sabol | 252/33 |
| 4,122,266 | 10/1978 | deVries | 252/34 |
| 4,372,862 | 2/1983 | Miller | 252/39 |
| 4,475,949 | 10/1984 | Ross et al. | 252/39 |

FOREIGN PATENT DOCUMENTS

| | | | |
|---|---|---|---|
| 0120665 | 3/1984 | European Pat. Off. . | |
| 1246545 | 2/1969 | United Kingdom | 252/33 |

*Primary Examiner*—William R. Dixon, Jr.
*Assistant Examiner*—Ellen McAvoy
*Attorney, Agent, or Firm*—Morgan & Finnegan

[57] ABSTRACT

A composition for the preparation of a soluble-oil for use in a cutting fluid comprises a mineral oil and, as an emulsifier, an effective amount of a sulphonate of a branched polymer of $C_3$ to $C_5$ olefin. Preferably the polyolefin chain of the sulphonate has an average molecular weight in the range 275 to 560 and the polyolefin is polyisobutene.

A soluble-oil can be prepared from the above composition by the addition of a conventional corrosion inhibitor and diluted with water to make a cutting fluid. Advantages of the novel emulsifier are that they are resistant to breakdown by micro-organisms and do not require the addition of a coupling agent.

15 Claims, No Drawings

SOLUBLE-OIL CUTTING FLUID

This invention relates to a composition suitable for the preparation of a soluble-oil for use in a cutting fluid, to the soluble-oil prepared from the composition and to an oil-in-water emulsion containing the soluble-oil, which emulsion is suitable for use as a cutting fluid.

Soluble-oil emulsions are well known as cutting fluids. The term "soluble-oil" although used throughout the industry is, in fact, a misnomer because the constituents are not soluble in water. The soluble-oils are basically mineral oils blended with emulsifiers and other additives which, when added to water and stirred, form an oil-in-water emulsion. The emulsion allows the good cooling properties of water to be utilised in the metal working process whilst the oil and additives provide lubrication and corrosion inhibiting properties.

Our European Patent Application No. 120665 discloses the use of an alkyl benzene sulphonate as an emulsifer in soluble-oil emulsions.

It has now been found that a sulphonate of a branched polymer of a $C_3$ to $C_5$ olefin can be used as an emulsifier and that these sulphonates are resistant to breakdown by micro-organisms.

According to the present invention a composition suitable for the preparation of a soluble-oil for use in a cutting fluid comprises a mineral oil and, as an emulsifier, an effective amount of a sulphonate of a branched polymer of a $C_3$ to $C_5$ olefin.

Preferably the average molecular weight of the polyolefin chain of the sulphonate is in the range of 275 to 560.

Preferably the $C_3$ to $C_5$ olefin is isobutene.

The sulphonate can be in the form of an amine salt, an alkali metal salt, an alkaline earth metal salt or an ammonium salt.

In use soluble-oil emulsions may become contaminated by bacteria, yeasts and moulds. The growth of these micro-organisms may cause problems such as emulsion breakdown, the production of slimes and fungal mats and the evolution of foul odours. Biocides of biostatic agents are often therefore included in soluble-oil formulations to control microbial growth. The term biostatic agent refers to a material which prevents the growth of micro-organisms above a certain level but does not necessarily kill all the micro-organisms. It has surprisingly been found that at least some of the soluble-oils according to the invention are biostatic even when a conventional biostatic agent is not included in the formulation.

It has been previously proposed to include emulsifiers in the soluble-oil but these may not readily form a stable blend with the mineral oil and so a coupling agent is commonly required to bind the emulsifier to the oil. Conventional coupling agents include, for example, volatile alcohols such as sec.butanol, butyl oxitol or cyclohexanol. The volatility of these coupling agents means that over a period of time coupling agent is lost from the soluble-oil by vaporization. This loss of coupling agent reduces the stability of the soluble-oil and is often associated with an objectionable smell. Further, the coupling agents have relatively low flash points which means that great care must be taken when they are blended or otherwise handled.

It is an advantage of the present invention that the soluble-oil is relatively stable without the need for a conventional coupling agent.

The soluble oil, prior to dilution with water may contain an effective amount of a fatty acid diethanolamide as a corrosion inhibitor, for example, from 1 to 5% by weight of the total weight of the soluble oil and/or an effective amount of a polyisobutene succinimide as an emulsifer, for example from 1 to 8% by weight of the total weight of soluble oil.

Preferably the soluble-oil also contains an effective amount of alkanolamine eg a mixed alkanolamine borate corrosion inhibitor, suitable amounts of which are in the range 1 to 5% by weight of the total weight of soluble oil.

Suitably, the soluble-oil according to the present invention comprises the following amounts of the components;

| Component | Amount (% of total weight) |
|---|---|
| Fatty acid diethanolamide | 1 - 5 |
| Polyisobutenesuccinimide | 2 - 8 |
| Polyolefinic sulphonate salt | 2 - 15 |
| Mixed alkanolamine borate | 0 - 5 |
| Mineral Oil | balance |

The salt of the branched chain polyolefinic sulphonate may be prepared by conventional methods and is preferably selected from the group comprising sodium, monoethanolamine, diethanolamine, triethanolamine, ammonium and calcium salts. The branched chain polyolefinic part of the sulphonate is preferably a polymer of a $C_3$ to $C_5$ alkene. A particularly suitable alkene is isobutene. The polyolefin may be prepared from a pure alkene feed or may be prepared from a feed comprising a major proportion of a branched alkene and minor proportions of other isomers of the alkene. For example suitable polybutenes include those commercially available from BP Chemicals Limited under the Trade Mark Hyvis which are made from a feed comprising a major proportion of isobutene and minor proportions of butene-1 and butene-2. The polyisobutene chain of the sulphonate salt has an average molecular weight in the range 275 to 560. The use of a sulphonate salt prepared from a polyolefin having a molecular weight above 275 improves the corrosion inhibiting propeties of the soluble-oil whereas the use of a sulphonate salt prepared from a polyolefin having a molecular weight below 560 improves the emulsion stability of the soluble-oil. The choice of the molecular weight of the polyolefin therefore involves a compromise.

A mixture of different sulphonate salts may be used in soluble oils according to the invention.

The fatty acid diethanolamides are preferably formed by the reaction of diethanolamine with naturally occurring fatty acids having from 12 to 20 carbon atoms. The fatty acids may be saturated or unsaturated but are preferably unsaturated.

The alkanolamine borate corrosion inhibitor is preferably one that comprises the reaction products of more than one alkanolamine with boric acid. The alkanolamines may be selected from monoethanolamine, diethanolamine, triethanolamine and N,N dimethyl ethanolamine. A preferred combination of alkanolamines is mono- and di-ethanolamine.

The polyisobutene succinimide emulsifier is preferably overbased with excess amine and preferably has a molecular weight of from 1000 to 3000.

The soluble-oil formulation may also contain a small amount of distilled water e.g. from 0.01 to 2% by weight of the total weight of the soluble-oil. The distilled water improves the stability of the blend.

An effective amount of a defoaming agent such as a Friedel Krafts way may also be included in the soluble oil. A suitable wax is SASOL wax SH 105 supplied by Weber. The amount of defoaming agent is preferably up to 0.1% by weight of the total weight of the soluble-oil.

The soluble-oils according to the present invention may also contain conventional corrosion inhibiting additives such as, for example, the commercially available corrosion inhibitor sold by Hoechst under the trade name Hostacor H which comprises a solution of arylsulphonamidocarboxylic acid (90%) in water (6%) and amine (4%).

Although a wide range of mineral oils may be used in the soluble-oil formulations according to the present invention, base oils designated 100 to 500 solvent neutral have been found to be particularly suitable, i.e. paraffinic oils typically having kinematic viscosities at 40° C. in the range 2 to 100 centistokes more particularly 10 to 60 centistokes.

If a biocidal soluble-oil is required, a conventinal biocide may be included in the formulation.

The soluble-oil according to the present invention is relatively stable and when mixed with water readily forms an emulsion which may be used as a cutting fluid. The term cutting in the present specification is also intended to include metal working operations such as drilling and grinding. Preferably, the emulsion has a water to soluble-oil weight ratio of from 10:1 to 40:1 although higher and lower dilutions may be useful in certain applications.

The invention is illustrated with reference to the following example.

EXAMPLE

Two soluble oil formulations were prepared by mixing the following components:

| Component | Amount (% by weight) Formulation A | Formulation B |
|---|---|---|
| Diethanolamine salt of a polyisobutylene sulphonate | 9.0 | 12.0 |
| P 3915 (a fatty acid diethanolamide sold by Unichema) | 2.5 | 2.5 |
| Mixed alkanolamine borate (sold by Hythe Chemicals) | 2.5 | 2.5 |
| L 5602 (polyisobutenesuccinimide sold by Lubrizol) | 5.0 | 5.0 |
| Hostacor H as corrosion inhibitor (arylsulphonamidocarboxylic acid in water and amine sold by Hoechst) | 1.0 | 1.0 |
| Paraffinic Base Oil of viscosity 20 centistokes at 40° C. | 80.0 | 77.0 |
| Sasol Wax H 105 (antifoam agent) | 0.1 | 0.01 |

The polyolefinic sulphonate salt comprises a sulphonated polyisobutene, the polyisobutene having an average molecular weight of 330, neutralized with diethanolamine.

Formulation B is similar to Formulation A except that it contains more of the polyolefinic sulphonate salt.

Both formulations were prepared by first mixing the polyisobutene sulphonate with the mineral oil with stirring. Then the other components were added in the order listed.

The thermal stability of formulation A was tested after 7 days at temperatures of 0° C. and 40° C. using a method based on the Institute of Petroleum test method IP 311, Thermal Stabilility of Emulsifiable Cutting Oil. The formulation was stable at both temperatures.

PREPARATION OF CUTTING FLUIDS

Samples of soluble-oil formulation A were mixed with mains tap water at weight ratios of water to oil of from 20:1 to 70:1. The oil readily emulsified in the water at each dilution.

CORROSION TEST

Each of the emulsions was subjected to the Insititute of Petroleum standard test method IP 125 Aqueous Cutting Fluid Corrosion of Cast Iron. At each dilution there was no visible staining or pitting. A copper strip was partially immersed in an emulsion of formula A having a water to oil weight ratio of 20:1. The emulsion was maintained at a temperature of 40° C. for 14 days, and then the copper strip was examined for staining over the area which had been immersed in the emulsion, over the area which had remained above the emulsion and at the interface between these two areas. There was no visible staining at any of the three areas.

EMULSION STABILITY TEST

The emulsion stability of the 20:1 water to oil emulsion of formulation A was assessed using the Institute of Petroleum standard test method IP 263 Emulsifiable Cutting Oil Emulsion Stability. The emulsion passed the test in that the total separation of oil and cream was less than 0.1 ml after standing for 24 hours.

MICROBIAL DEGRADATION TEST

A test rig was used to evaluate the microbial degradation of the soluble-oil emulsions in a simulated workshop operation. The rig comprised a reservoir for the cutting fluid and an air lift pump to transfer the fluid from the reservoir to a funnel containing metal cuttings, the funnel being mounted over the reservoir so that the fluid drained back into the reservoir. Duplicate samples of formulation B diluted with mains tap water in the ratio of water to oil of 20:1 were tested in the test rig. An inoculum prepared from a mixed culture of fungi and bacteria originating from a spoiled cutting oil emulsion was added to the test samples so that an initial total viable count of approximately $10^6$ micro-organisms per milliliter of emulsion was obtained. Air was passed through the rig to circulate and aerate the fluid during normal working hours from Monday to Friday each week. Each Monday morning, viable counts of aerobic bacteria, yeasts and moulds were prepared and the presence of sulphide producing bacteria, evolution of $H_2S$, pH and emulsion stability were determined.

Up to the end of 11 weeks, the emulsion had not evolved $H_2S$ or encouraged yeast, mould or fungal growth. The total viable bacteria count remained in the order of $10^6$ organisms per milliliter of emulsion throughout the test. The emulsion was relatively stable over the period of the test and the pH which was initially 9.0 fell to around 8.0 during the test period.

The results show that formulation B, which contains no conventional biocide or coupling agent, forms a relatively stable emulsion which surprisingly has biostatic properties and does not evolve $H_2S$.

We claim:

1. A composition suitable for the preparation of a soluble-oil for use in a cutting fluid which composition comprises a mineral oil and, as an emulsifier, an effective amount of a sulphonate of a branched polymer of a $C_3$ to $C_5$ olefin wherein the average molecular weight of the polyolefin chain of the sulphonate is in the range 275 to 560.

2. A composition as claimed in claim 1 wherein the $C_3$ to $C_5$ olefin is isobutene.

3. A composition as claimed in claim 1 wherein the mineral oil is a parrafinic oil having a kinematic viscosity at 40° C. in the range 2 to 100 centistokes.

4. A composition as claimed in claim 1 wherein the amount of sulphonate is from 1 to 20% by weight based on the total weight of mineral oil and sulphonate.

5. A composition as claimed in claim 1 wherein the composition consists substantially of the mineral oil and the sulphonate.

6. A soluble-oil suitable for dilution with water to prepare a cutting fluid, the soluble-oil comprising a composition as claimed in claim 1 and containing in addition an effective amount of a fatty acid diethanolamide corrosion inhibitor.

7. A soluble-oil suitable for dilution with water to prepare a cutting fluid, as claimed in claim 6 and containing in addition an effective amount of a polyisobutene succinimide emulsifier.

8. A soluble-oil suitable for dilution with water to prepare a cutting fluid, as claimed in claim 1 and containing in addition an effective amount of an alkanolamine borate corrosion inhibitor.

9. A soluble-oil prepared from a composition as claimed in claim 1, said soluble-oil being substantially free of a coupling agent.

10. An oil in water emulsion suitable for use as a cutting fluid which oil in water emulsion comprises a soluble oil and water, said soluble oil comprising a mineral oil and, as an emulsifier, an effective amount of a sulphonate of a branched polymer of a $C_3$ to $C_5$ olefin wherein the average molecular weight of the polyolefin chain of the sulphonate is in the range 275 to 560.

11. An oil in water emulsion as claimed in claim 10 wherein the $C_3$ to $C_5$ olefin is isobutene.

12. An oil in water emulsion as claimed in claim 10 wherein the mineral oil is a parrafinic oil having a kinematic viscosity at 40 C. in the range 2 to 100 centistokes.

13. An oil in water emulsion as claimed in claim 10 wherein the amount of sulphonate is from 1 to 20% by weight based on the total weight of mineral oil and sulphonate.

14. An oil in water emulsion as claimed in claim 10 wherein the composition consists substantially of water, the mineral oil and the sulphonate.

15. An oil in water emulsion as claimed in claim 10 containing in addition an effective amount of a fatty acid diethanolamide corrosion inhibitor.

* * * * *